United States Patent [19]

Jones

[11] Patent Number: 5,068,986

[45] Date of Patent: Dec. 3, 1991

[54] EXCAVATING TOOTH POINT PARTICULARLY SUITED FOR LARGE DRAGLINE BUCKETS

[75] Inventor: Larren F. Jones, Aloha, Oreg.

[73] Assignee: Esco Corporation, Portland, Oreg.

[21] Appl. No.: 574,799

[22] Filed: Aug. 30, 1990

[51] Int. Cl.[5] ..... E02F 9/28; E21B 10/62

[52] U.S. Cl. ..... 37/142 A; 37/141 T; 37/142 R; 299/92; 403/379

[58] Field of Search ..... 37/142 A, 142 R, 141 R, 37/141 T; 299/91-93; 172/719, 701.3; 403/378-379

[56] References Cited

U.S. PATENT DOCUMENTS

| | | | |
|---|---|---|---|
| 1,874,783 | 8/1932 | Mekeel | 37/142 A |
| 2,312,802 | 3/1943 | Crawford | 37/142 A |
| 2,483,032 | 9/1949 | Baer | 37/142 A |
| 2,635,366 | 4/1953 | Hostetter | 37/142 A |
| 2,846,790 | 8/1958 | Davis et al. | 37/142 A |
| 2,919,506 | 1/1960 | Larsen | 37/142 R |
| 3,121,289 | 2/1964 | Eyolfson | 37/142 A |
| 3,388,488 | 6/1968 | Duplessis | 37/142 A |
| 4,187,035 | 2/1980 | Colburn | 37/142 A |
| 4,271,615 | 6/1981 | Jones | 37/142 A |
| 4,326,348 | 4/1982 | Emrich | 37/142 R |
| 4,716,668 | 1/1988 | Hahn | 37/142 A |
| 4,727,663 | 3/1988 | Hahn | 37/142 A |

FOREIGN PATENT DOCUMENTS

| | | | |
|---|---|---|---|
| 641404 | 5/1962 | Canada | 37/142 A |
| 729862 | 3/1966 | Canada | 37/142 A |
| 1263030 | 2/1972 | United Kingdom | 37/142 A |
| 2207691 | 2/1989 | United Kingdom | 299/92 |

*Primary Examiner*—Dennis L. Taylor
*Assistant Examiner*—Spencer Warnick
*Attorney, Agent, or Firm*—Tilton, Fallon, Lungmus & Chestnut

[57] ABSTRACT

An excavating tooth point having a pin receiving opening, a cavity in the point in communication with the opening and a resilient lock for the pin in the cavity.

11 Claims, 6 Drawing Sheets

EXCAVATING TOOTH POINT PARTICULARLY SUITED FOR LARGE DRAGLINE BUCKETS

BACKGROUND AND SUMMARY OF INVENTION

This invention relates to an excavating tooth point and, more particularly, one advantageously employed on large dragline buckets where the teeth are of substantial size.

For over a century, excavating teeth have been provided in two parts, viz., an adapter attached to the excavator, dragline bucket, shovel dipper, etc., and a replaceable point. It has been the experience of operators of excavating equipment that from 5 to 30 points can be used before a given adapter is worn to the extent of needing replacement. The easy replaceability of points is important because it provides a renewed, sharp penetrating edge, minimizes the amount of throw-away metal, and also minimizes down time—the latter being an especially economic factor with large excavating machinery—see, for example, co-owned U.S. Pat. No. 4,716,668 and 4,727,663.

There have been many locking concepts developed for two-part tooth systems over the years with varying degrees of success in regard to reliability, and ease of installation and removal. However, none of them were both reliable, and easy to install and remove in all types of applications. This is especially true for the large two-part systems used on large draglines. These systems mostly used side pins and snap rings, or spools and wedges. Side pins, for example, are seen in co-owned Pat. No. 4,326,348 and are at times extremely difficult to remove because of the impacted fines and the closeness of adjacent teeth. Spool and wedge removal as seen in co-owned Pat. No. 3,121,289 requires the inconvenience of turning a dragline bucket up on its front end to access the wedges so that they can be sledged out. Also, because wedges can eject during service, it is common practice in many installations to tack-weld wedges to their mating spools thereby making wedge removal even more difficult.

The problems of the prior art have been resolved by the instant invention which features a tooth point having a cavity communicating with the upper pin receiving opening of a point and which is adapted to receive a lock engageable with a slot in a vertically extending pin.

Other objects and advantages of the invention may be seen in the details of the ensuing specification.

DETAILED DESCRIPTION

Figure 1:
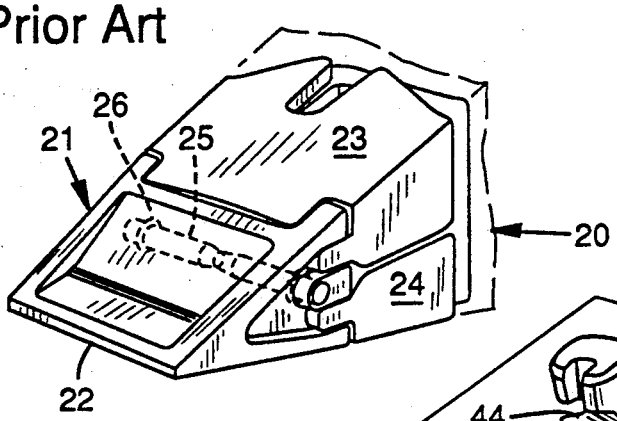
FIG. 1 Prior Art
FIG. 1 is a perspective view of the prior art.
Figure 2:
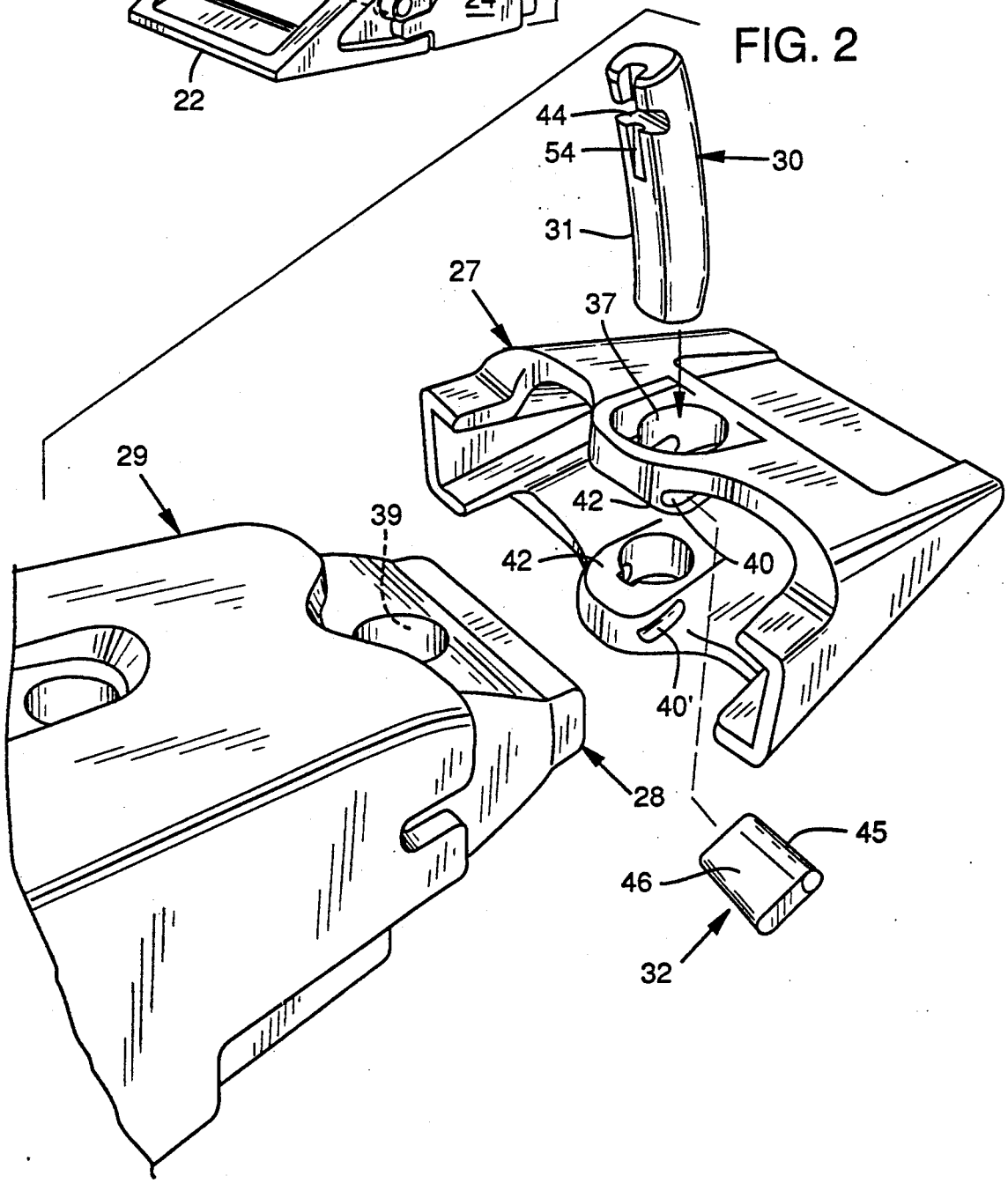
FIG. 2 is an exploded perspective view of the preferred embodiment of the inventive tooth point and associated elements.

In the drawing and with reference first to FIG. 1 which represents the prior art as seen in Pat. No. 4,326,348, the numeral 20 designates generally an adapter while the numeral 21 generally designates a tooth point having an earth engaging edge 22. The adapter 20 is protected by wear caps 23 and 24. The point 22 is secured to the adapter 20 by means of side pins as at 25 which are equipped with snap rings as at 26.

Figure 6:
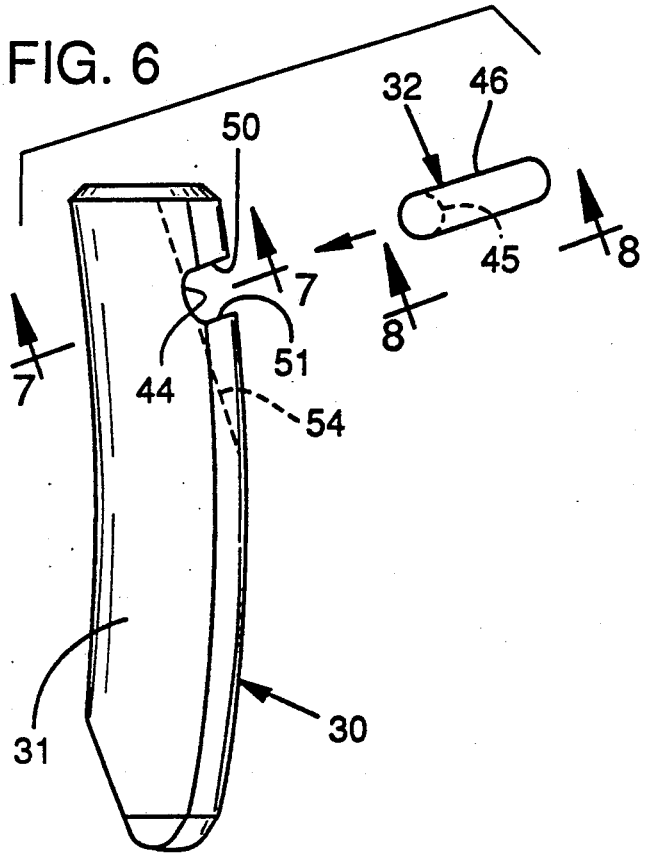
FIG. 6 is a side elevational view of the locking means employed in the practice of the invention with the lock shown exploded from the locking pin.

According to the invention, a tooth point generally designated 27 is mounted on the nose 28 of an adapter generally designated 29. The point and adapter nose are releasably secured together by locking means generally designated 30 which include a vertically extending pin 31 (see also FIG. 6) and a lock generally designated 32.

More particularly, the point 27 is equipped with a top wall 33 and a bottom wall 34 which cooperate with sidewalls as at 35 in defining a socket 36 for the receipt of the adapter nose 28.

The top and bottom walls 33, 34 are equipped with vertically aligned pin receiving openings as at 37 and 38 respectively. The nose 28 is equipped with an alignable opening 39 for the receipt of the locking pin 31.

The foregoing is generally in accord with prior art teeth which have vertically extending pin locks as contrasted to the showing in FIG. 1—see, for example, co-owned Pat. No. 2,846,790. The invention departs from the prior art in the novel location of the lock or keeper for the pin which, for the first time, is provided within the point itself as contrasted to being provided in a chamber of the adapter. Here the lock or keeper 32 is mounted only within the cavity 40 provided entirely within the point 27.

The Inventive Construction

Figure 3:
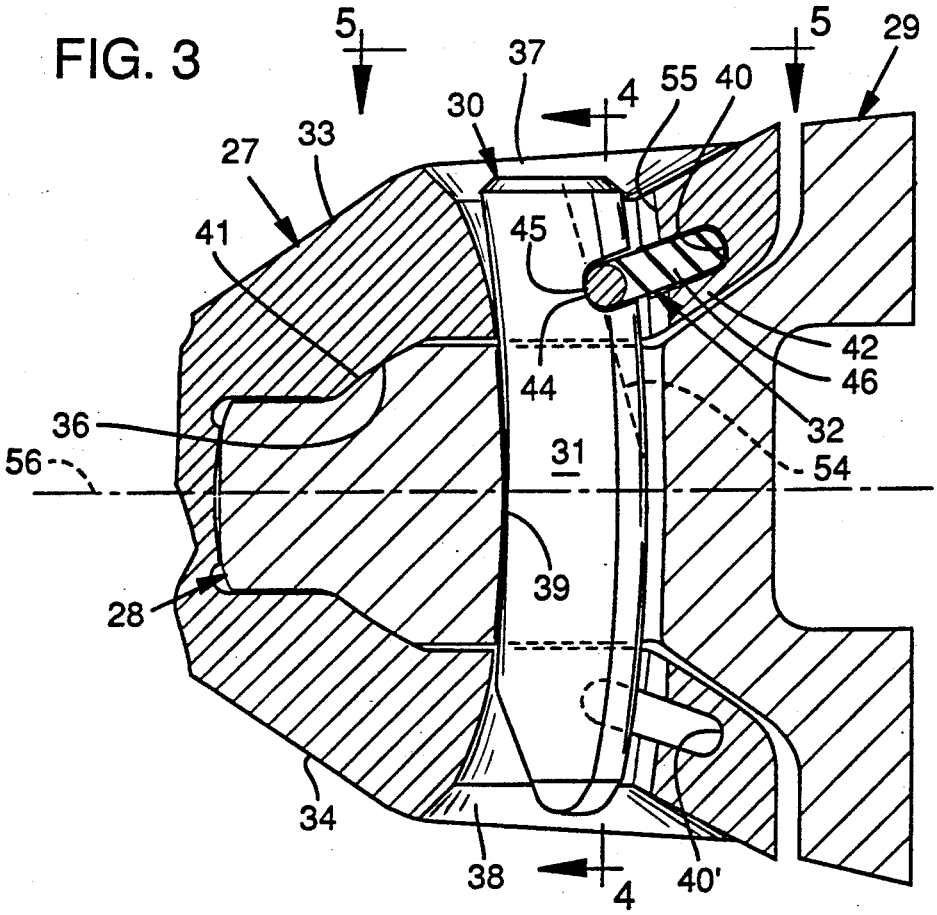
FIG. 3 is a fragmentary side elevational view partially in section of an excavating tooth point constructed according to the teachings of this invention.
Figure 4:
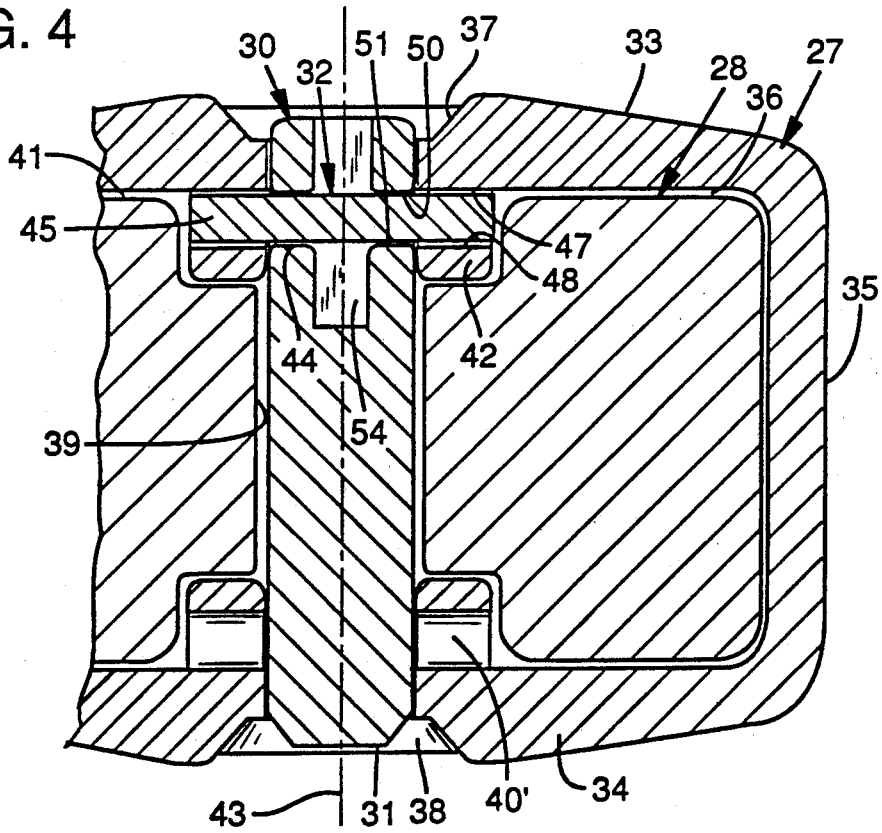
FIG. 4 is a sectional view taken along the sight line 4—4 of FIG. 3.

As can be appreciated from a consideration of the upper portions of FIGS. 3 and 4, the top wall 33 of the point has an inner surface 41 which, in part, defines the socket 36. Depending from the top wall 33 and as an integral part thereof is a boss 42 which, as can be readily appreciated from FIG. 4, is located on both sides of the vertical-longitudinal midplane 43. It is in a cavity 40 within the boss 42 that the lock 32 is positioned and the lock extends outwardly of the cavity 40 to engage a slot 44 in the pin 31—see FIG. 6.

Figure 8:
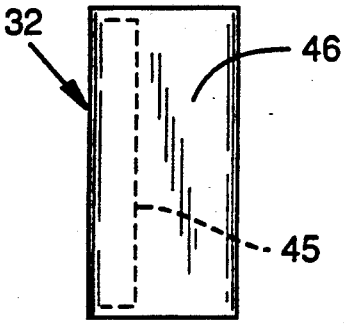
FIG. 8 is a bottom plan view of the lock such as would be seen along the sight line 8—8 of FIG. 6.
Figure 9:
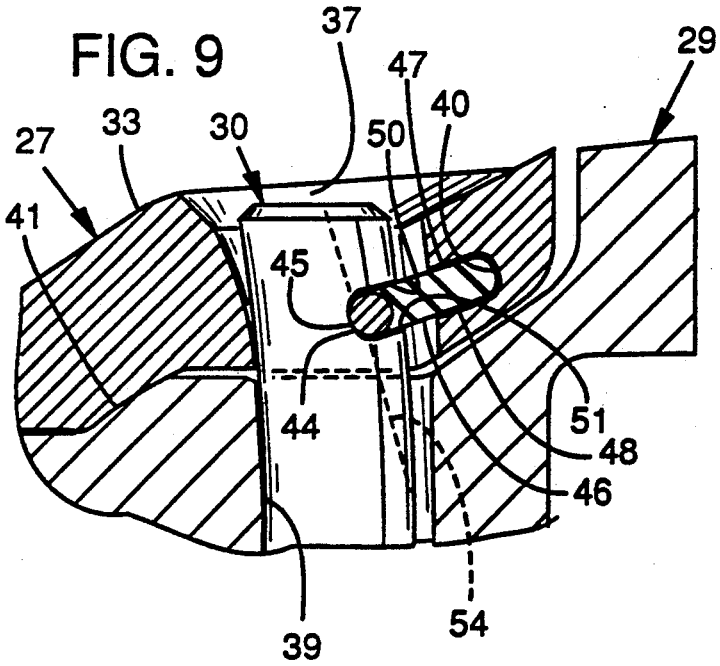
FIG. 9 is a view similar to the upper central part of FIG. 3 and which shows the operation of the invention.

The lock 32 features a dowel 45 (compare FIGS. 6 and 8) which is essentially cylindrical with the remainder of the lock being constructed of elastomeric material (polyurethane foam) which encases and backs the dowel 45 as at 46. Under certain circumstances, a spring may also be used to advantage with the elastomer to back the dowel 45. The circular cross-sectional shape of the dowel 45 is advantageous although other geometric shapes could be used.

The lock cavity 40 is located so that the lock dowel 45 is aligned with the lock retention slot 44 in the pin 31. Further, the cavity 40 is equipped with opposing surfaces as at 47 and 48 (see the right hand side of FIG. 4) which support both ends of the lock 32. The opposing surfaces are arranged in such a way that they act in conjunction with the lock retention slot to pinch or hold the dowel 45 in place when the pin 31 attempts to move up or down. This positively prevents undesirable pin ejection during service. The lock elastomer 46 also assists in holding the dowel 45 in place.

When the pin 31 attempts to eject downwardly, the arrangement shown has an approximately 10 degree pinching or holding angle O (see FIG. 10) between the lock retention slot surface 50 and the cavity surface 48. Conversely, when the pin attempts to eject upwardly, the pinching or holding angle O is between the lock retention slot surface 51 and the cavity surface 47.

Figures 10, 11:
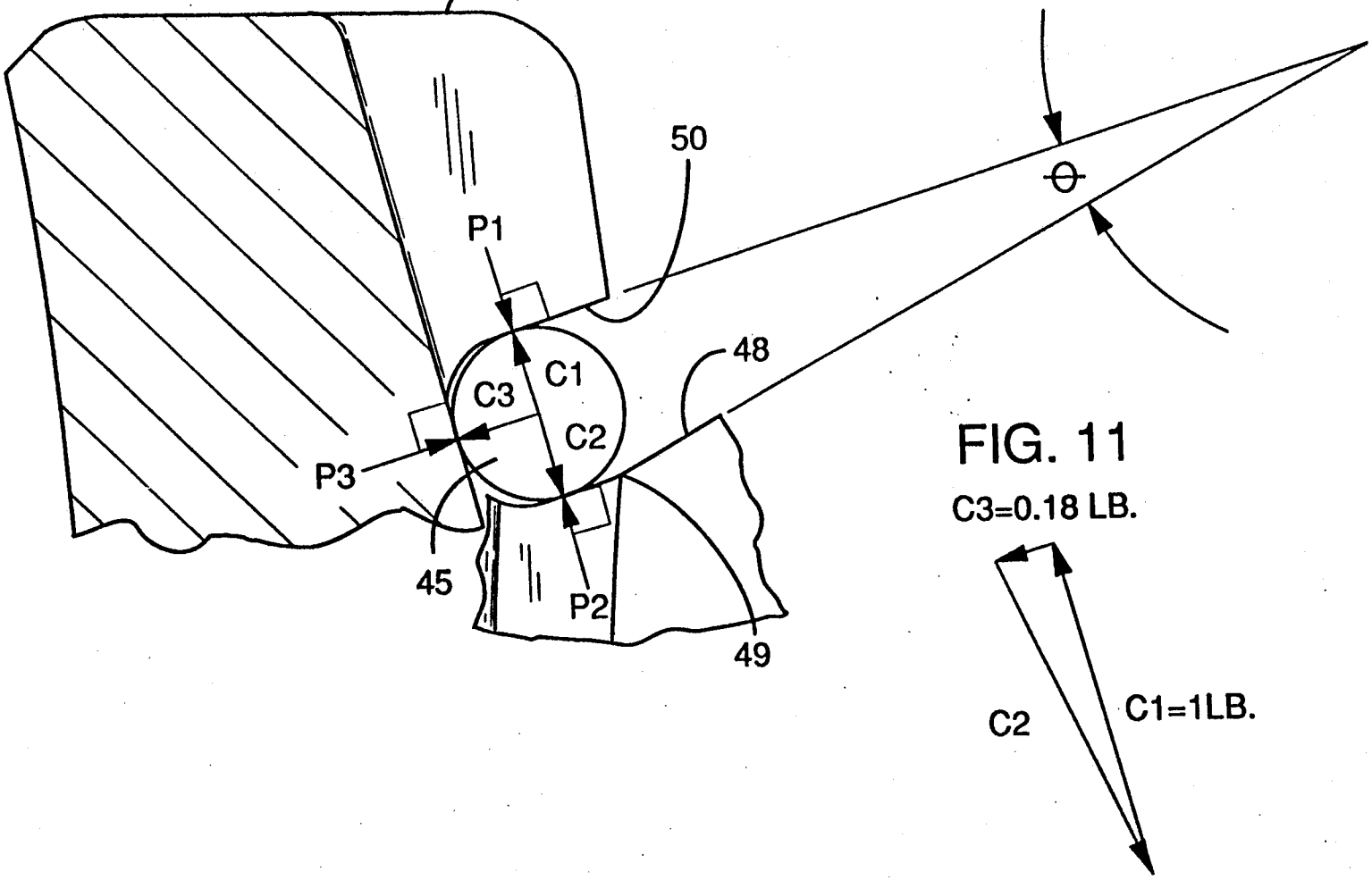
FIG. 10 is an enlarged fragmentary sectional view similar to FIG. 7 and showing force vectors.
FIG. 11 is a vector diagram of the force vectors of FIG. 10.

FIG. 10 shows a diagram of the forces acting on the dowel 45 when the pin 31 attempts to move downwardly. Thus, the downward force vector P1 exerted by the pin 31 is opposed by the force vectors P2 and P3. P2 is exerted by the point surfaces 48 and P3 by the pin 31. FIG. 10 also shows the reaction forces in the dowel 45 itself, being respectively C1, C2 and C3—each one being normal to the surface contacting the dowel 45.

By setting up a graphic solution (FIG. 11), we find that for every 1 LB. force P1 exerted downwardly by the pin 31, there is an 0.18 LB reaction force C3 pushing the dowel 45 into the lock slot 44. Additionally for the dowel 45 to move out of the lock slot 44, it must overcome an interference as at 49 and push the pin 31 upwardly.

The interference as at 49 is based upon the fact that the point has parallel lower cavity surfaces 48 which are at an angle O with respect to the parallel surfaces 50 defining the upper extent of the slot 44. Both the force C3 and the interference 49 hold the dowel 45 in place. As just explained, this interference is caused by the angle between the pin slot upper surfaces and lock cavity bottom surfaces. Thus, this is the reason for calling this feature the "dowel pinching or holding angle" which advantageously may be of the order of about 5° to 10°, optimally about 10°.

This same type of action occurs when the pin attempts to eject upwardly. The same dowel pinching or holding function can be alternatively achieved by using arcuate surfaces or small protrusions or other geometries to work in conjunction with other than circular dowel cross sectional shapes.

Lock Means Modification

Figure 12:
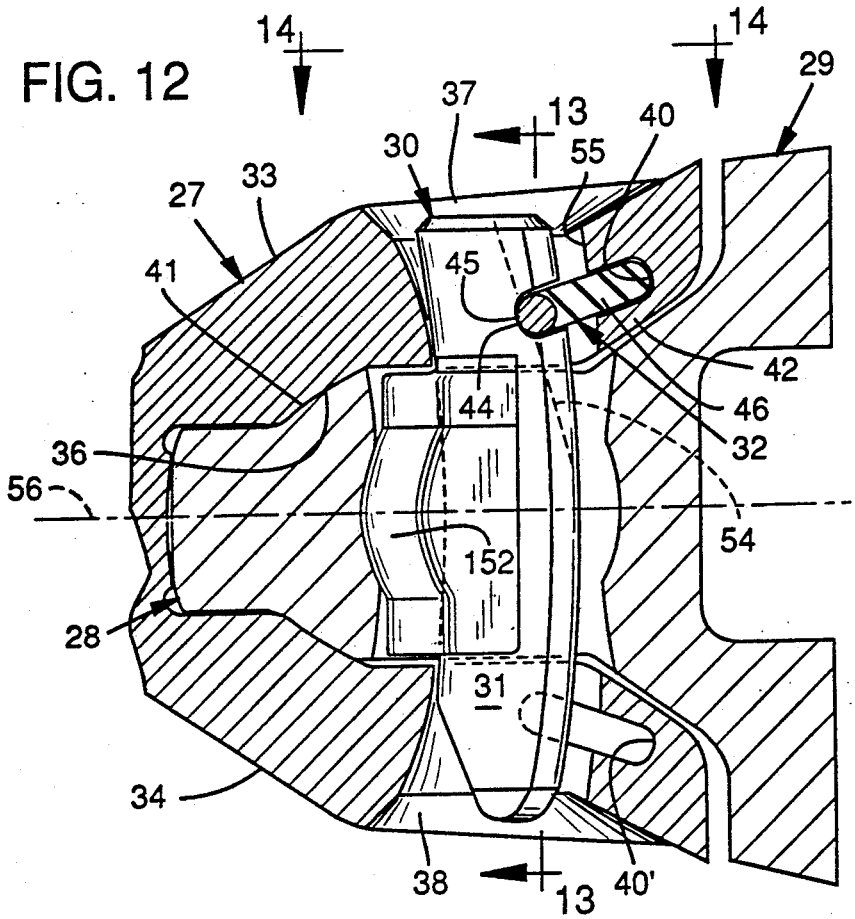
FIG. 12 is a view similar to FIG. 3 but of a modified form of locking means and adapter.
Figure 13:
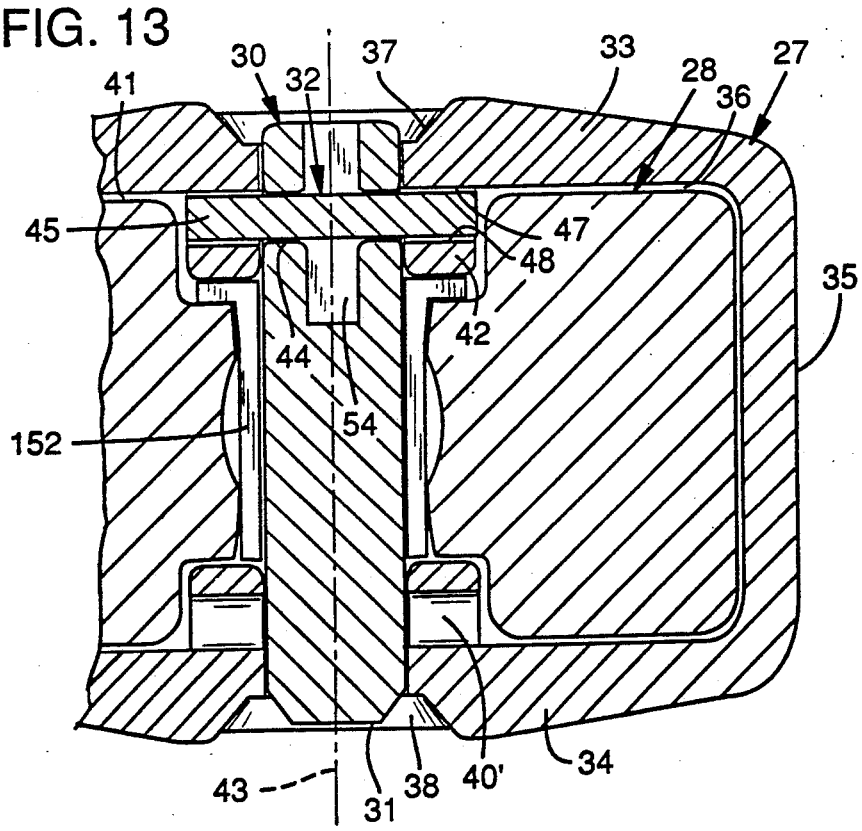
FIG. 13 is a sectional view such as would be seen along the sight line 13—13 of FIG. 12.
Figure 14:
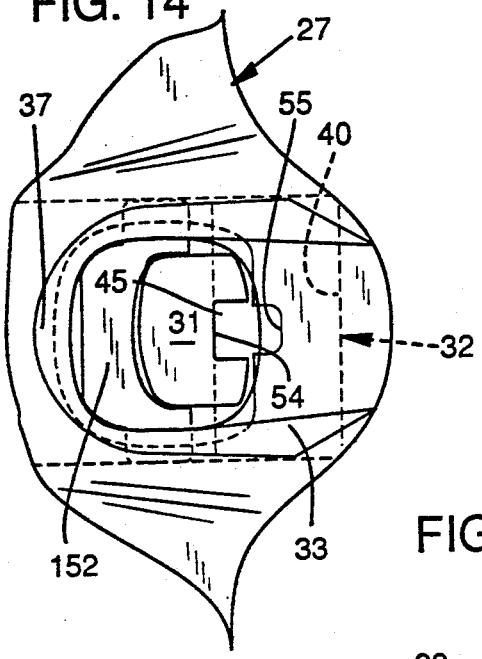
FIG. 14 is a top plan view of the nose keyway such as would be seen generally along the sight line 14—14 applied to FIG. 12.

A modified form of lock means can be seen in FIGS. 12–14 where the elements are the same except for the fact that the nose opening is enlarged to accommodate a spring collar as at 152. This is advantageous for retrofitting installations already in the field.

ASSEMBLY AND DISASSEMBLY

For assembly, the lock 32 is inserted into the top side of lock cavity 40. The point is mounted on the nose and the key ways 37–39 aligned. The pin 31 is inserted into the top keyway 37 and driven downward to compress the dowel pin 45 back into the locked cavity 40 until the dowel 45 snaps into the lock slot 44.

Figure 5:
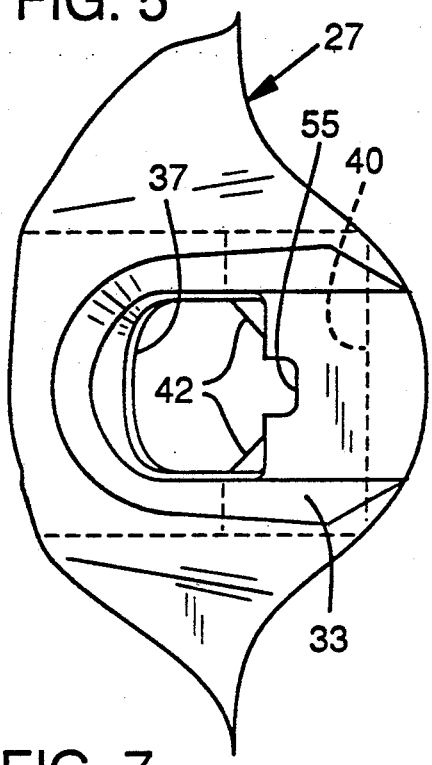
FIG. 5 is a fragmentary top plan view such as would be seen along the sight line 5—5 of FIG. 3.
Figure 7:
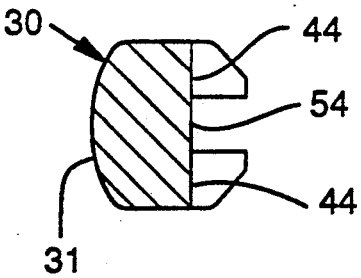
FIG. 7 is a sectional view taken along the sight line 7—7 of FIG. 6.
Figure 15:
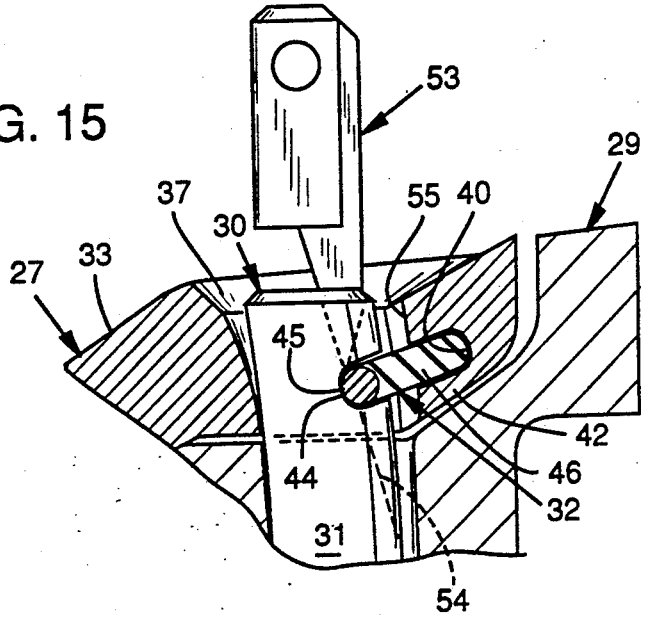
FIG. 15 is a fragmentary side elevational view essentially similar to FIG. 12 of the first stage of pin removal incident to disassembly of the point and adapter.
Figure 16:
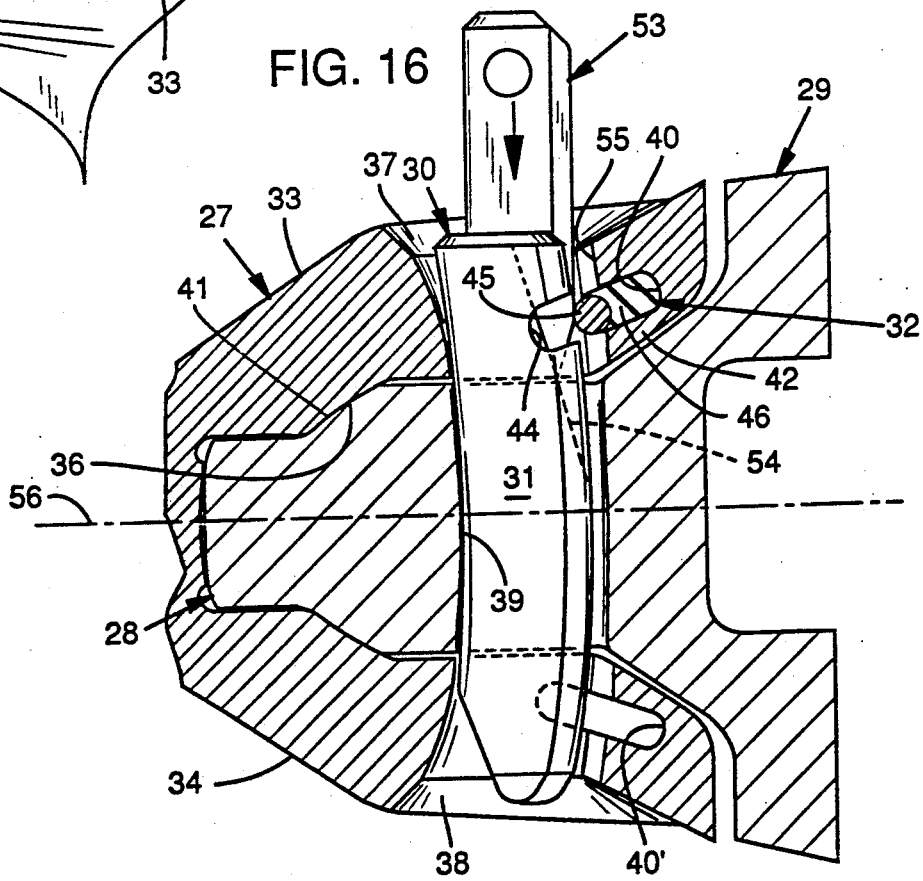
FIG. 16 is a view similar to FIG. 15 but showing the parts in a subsequent condition.

Disassembly is illustrated in FIGS. 15 and 16 wherein a tool 53 which also may be a screwdriver, small crow bar or sharp end of a tire iron, is inserted into aligned recesses 54, 55 in pin 31 and top wall 33, respectively—compare FIGS. 5 and 7, also FIGS. 15 and 16. As appropriate, dowel 45 is either pried or wedged back into the plug cavity 40 and then pin 31 is driven down and out as illustrated in FIGS. 15 and 16. An earlier version of this removal technique can be seen in my Pat. No. 4,271,615.

The invention also accommodates rotation of the point, i.e., reversing the same to position the former bottom side uppermost. For this purpose, a second cavity 40' may be provided in the now-illustrated lower wall 34. This instance, the point 27 is symmetrical about the horizontal mid-plane 56 but with non-reversible constructions, this is omitted.

By locating the lock 32 within the point, the user is automatically assured of a proper lock each time a point is replaced. This insures reproducible holding power which was often lost in the past. In the past, users were reluctant to spend the time digging out a used lock from the adapter when a point was replaced. It was the time and labor required rather than the cost—because the lock cost was minor in comparison to the cost of the replacement point. Also, this necessitated expensive down time so that provision of the lock in the point achieves proper holding power without the loss of operating time.

Still further, the size of the cavity 40 is readily controlled so that the advantageous pinching action referred to occurs predictably which is not always the case with a lock positioned in a worn adapter. In other words, by virtue of mounting the lock within the point rather than the worn adapter, a reproducible result in operation is obtained. Through the invention, the manufacturer's designed fit of the point and the locking system is employed new—thus doing as much as possible to provide the strongest possible two-part tooth.

I claim:

1. An excavating tooth point comprising a relatively elongated body having an earth engaging forward end and a socket extending forwardly from the rear end, a pair of spaced apart, aligned openings in said point communicating the exterior of said point with said socket for receiving a pin releasably securing said point to an adapter, a cavity in said point communicating with one of said openings, said cavity being defined by upper and lower walls connected by a vertical wall and a resilient lock mounted in said cavity and projecting into one of said openings, said resilient lock being supported only by said point prior to engagement with said pin in said opening.

2. A tooth point for installation on an adapter, said tooth point comprising a relatively elongated unitary body having an earth-engaging edge at the forward end thereof and a socket extending forwardly from the rear end thereof, said point being defined by a top wall, a bottom wall and a pair of sidewalls, and aligned pin-receiving top and bottom wall openings in said top and bottom walls spaced forwardly of said rear end and communicating with said socket so as to be alignable with a pin-receiving opening in a nose of an adapter, said top wall adjacent the opening therein providing a top surface constituting party of the point exterior and a bottom surface providing part of said socket, said top wall opening providing a generally vertical surface connecting said top and bottom surfaces, said generally vertical surface being equipped with a cavity for receipt of a lock adapted to engage a pin in the openings of said point, said cavity having upper and lower walls extending generally perpendicularly to said sidewalls whereby said upper and lower walls are adapted to solely support a lock prior to engagement with a pin in said openings.

3. The point of claim 2 in which said point is generally symmetrical about the tooth longitudinally extending horizontal midplane, said bottom wall also being equipped with a cavity projecting from the opening therein.

4. The point of claim 2 in which said top wall has an integral boss depending from said bottom surface symmetrically about a longitudinally extending vertical midplane, said cavity being positioned in said boss.

5. The point of claim 2 in which said top wall opening has a rear surface constituting said generally vertical surface, a groove in said rear surface on the tooth's longitudinally extending vertical midplane for insertion of a disassembling tool.

6. A coupling for excavating equipment comprising a first member having a projection at the forward end thereof and a second member having a recess receiving said projection, said recess being defined in part by a top wall and a bottom wall, openings in said top and bottom walls for receiving a notched locking pin, said projection having an opening alignable with said top and bottom wall openings and said notched locking pin is installed in said top wall and projection openings, a cavity in said top wall communicating with said top wall opening, said cavity being defined by upper and lower walls connected by a vertical wall, and a resilient lock in said cavity engaging said locking pin notch.

7. An excavating tooth comprising an adapter having a nose at the forward end thereof, a point removably mounted on said nose and having a forwardly extending socket at the point rear end receiving said nose, said socket being defined by top, bottom and side walls of said point with openings in said top and bottom walls for receiving a notched locking pin, said nose having an opening aligned with said point openings and said notched locking pin is installed in said point and nose openings, the notch including top and bottom surfaces, a cavity in the top wall of said point communicating with the top wall opening, said cavity being defined by upper and lower walls connected by a vertical wall, and a resilient lock in said cavity engaging said locking pin notch without engaging said nose.

8. The tooth of claim 7 in which said cavity is rearwardly extending and said lock has a dowel at the forward end thereof engaging the notch of said pin.

9. The tooth of claim 7 in which said cavity lower wall is at a small acute angle to the notch top surface.

10. A coupling for excavating equipment comprising a first member having a projection at the forward end, a second member having an earth-engaging edge at the forward end thereof and a recess receiving said projection at the rear end thereof, said recess being defined in part by first and second walls, aligned openings in said walls for receiving a locking pin, said projection having an opening alignable with said first and second wall openings, a notched locking pin installed in said first and second wall and projection openings, a cavity in said first wall communicating with said first wall opening, said cavity being defined by first and second wall surfaces extending generally parallel to said first and second walls, said first and second wall surfaces being connected y a generally transverse wall surface spaced from said first wall opening, and a resilient lock in said cavity engaging said locking pin notch.

11. An earth-engaging replaceable member comprising a unitary body having an earth-engaging edge at the forward end thereof and a recess extending forwardly from the rear end thereof, said member being defined in part by first and second forwardly-extending walls, aligned pin-receiving openings in said first and second walls spaced forwardly of said rear end and communicating with said recess, said first wall adjacent the opening therein providing a first surface constituting part of the member exterior and a second surface providing part of said recess, said first wall opening providing a surface extending generally transverse to said first and second surfaces and connecting said first and second surfaces, said opening generally transverse surface being equipped with a cavity adapted to receive a lock for engagement with a pin in said first and second wall openings, said cavity being defined by first and second wall surfaces extending generally parallel to said first and second surfaces, said first and second wall surfaces being connected by a generally transverse wall surface spaced rearwardly from and generally parallel to said opening generally transverse surface whereby said cavity first and second wall surfaces are adapted to solely support a lock prior to engagement with a pin in said first and second wall openings.

* * * * *